United States Patent [19]

Saito

[11] 4,073,274

[45] Feb. 14, 1978

[54] AIR-FUEL METERING SYSTEM FOR INTERNAL COMBUSTION ENGINE AND APPARATUS TO CONTROL AIR FUEL RATIO OF AIR-FUEL BEING APPLIED TO ENGINE

[75] Inventor: Masaaki Saito, Yokohama, Japan

[73] Assignee: Nissan Motor Company, Limited, Japan

[21] Appl. No.: 630,802

[22] Filed: Nov. 11, 1975

[30] Foreign Application Priority Data

Nov. 12, 1974 Japan ..... 49-129582

[51] Int. Cl.[2] ..... F02M 59/10

[52] U.S. Cl. ..... 123/119 R; 60/285; 123/139 AW; 123/140 MC

[58] Field of Search ... 123/119 R, 139 AW, 140 MC, 123/DIG. 10; 60/276, 285

[56] References Cited

U.S. PATENT DOCUMENTS

| | | | |
|---|---|---|---|
| 3,548,794 | 12/1970 | Lazar | 123/119 R |
| 3,794,005 | 2/1974 | Turek | 123/119 R |
| 3,799,206 | 3/1974 | Matsui | 123/119 R |
| 3,871,338 | 3/1975 | Schmidt | 60/285 |
| 3,916,848 | 11/1975 | Schmidt | 123/119 R |
| 3,923,016 | 12/1975 | Hoshi | 123/119 R |
| 3,927,649 | 12/1975 | Stumpp | 123/119 R |
| 3,933,438 | 1/1976 | Bowler | 123/119 R |
| 3,937,195 | 2/1976 | Woods | 123/119 R |
| 3,949,551 | 4/1976 | Eichler | 60/285 |
| 4,000,614 | 1/1977 | Abthoff | 60/285 |

*Primary Examiner*—Charles J. Myhre
*Assistant Examiner*—Daniel J. O'Connor

[57] ABSTRACT

An air-fuel metering system employs a fluidic element which is circuited in such a manner that fuel supplied to the engine induction passage is varied not only to the venturi vacuum as modified by an output signal from an exhaust gas sensor placed in flow communication with the exhaust gases from the engine.

3 Claims, 5 Drawing Figures

CATALYTIC CONVERTER

AIR-FUEL METERING SYSTEM FOR INTERNAL COMBUSTION ENGINE AND APPARATUS TO CONTROL AIR FUEL RATIO OF AIR-FUEL BEING APPLIED TO ENGINE

The present invention relates to an air-fuel metering system for an internal combustion engine and also relates to an apparatus to control the air fuel ratio of an air-fuel mixture being applied to an internal combustion engine.

Among various air-fuel metering systems now available, an air-fuel metering system is known which utilizes a so-called fluidic element, which has no mechanically moving parts, in such a manner that fuel applied to an internal combustion engine is controlled, in amount, in response to the venturi vacuum. The fluidic element used in this known system includes a supply port, an output port, a vent port, two control ports and an interaction region. The output port is connected with an induction passage of the engine by an air-fuel mixture circuit and the vent port is connected with a fuel reservoir. One of the control port is exposed to the ambient atmosphere and is maintained at the atmospheric pressure, while the other port is connected to the venturi section of the induction passage and is exposed to the venturi vacuum. The fluidic element is constructed and arranged such that the two control ports are oriented at approximately 90° to a supply jet emerging into the interaction region from the supply port and the fuel is applied from the output to the air-fuel mixture circuit in response to the magnitude of the venturi vacuum. The system mentioned above has the advantage that because of the use of a fluidic element, it is simple and impact resistive, in construction, and inexpensive. However, since this system is an open loop control system, little or no ability to compensate for unforeseen external disturbances such as changes in system characteristics including changes in ambient temperature, changes in intake air temperature and changes in density and/or viscosity of fluids.

It is accordingly an object of the present invention to modify an air-fuel metering system of the above character in such a manner that it may be used in a closed loop control system using, as a controlled variable, an output signal from an exhaust gas sensor.

It is a specific object of the present invention to provide an apparatus to control the air fuel ratio of the air-fuel mixture being supplied to an internal combustion engine in which an air-fuel metering system of the above character as modified to conform to a closed loop control is used.

Figures 1, 2:
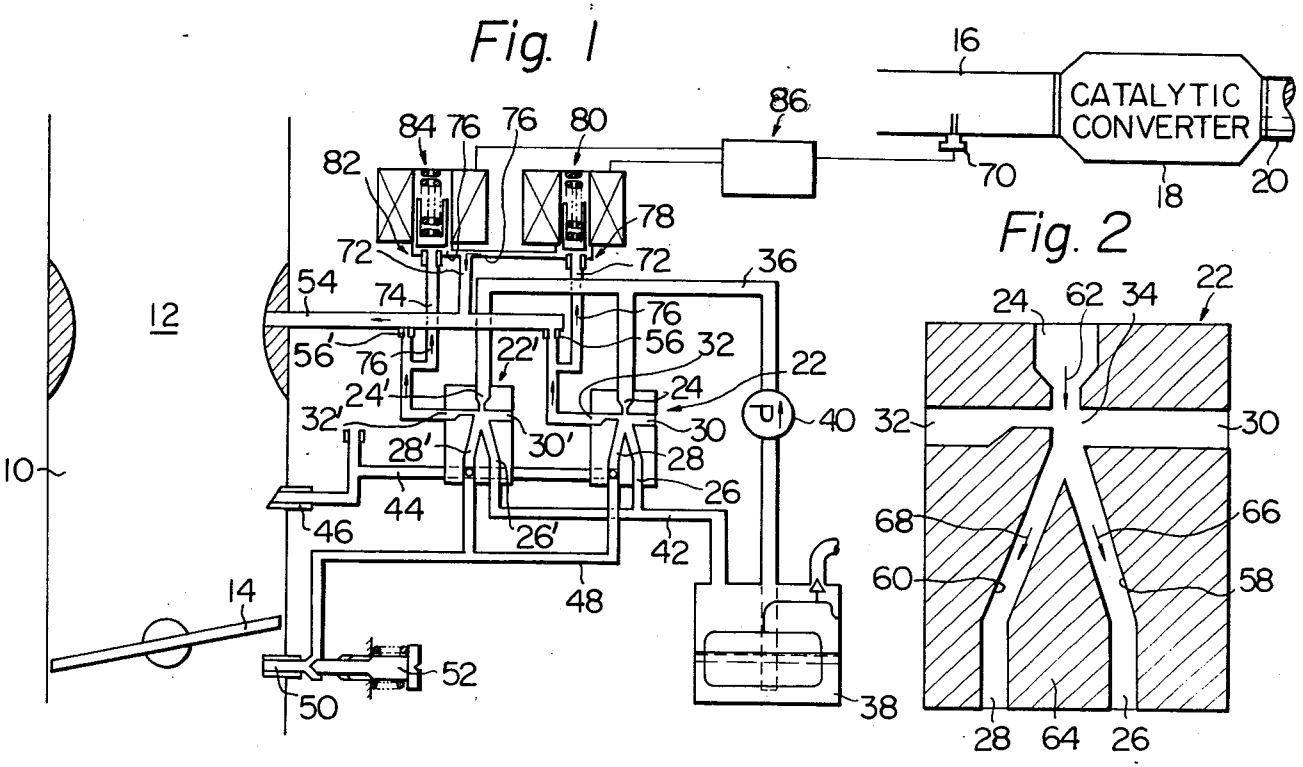
FIG. 1 is a schematic diagram of a preferred embodiment of the present invention.
FIG. 2 is a schematic cross-sectional enlarged view of a fluidic element.

Referring to FIG. 1 a conventional induction passage 10 is schematically illustrated which is provided with a venturi section 12 and a throttle flap 14. The induction passage 10 is connected to an intake manifold (not shown) of an internal combustion engine (not shown) having an exhaust manifold 16 which terminates in a catalytic converter 18, such as a three way catalytic converter. The output from the catalytic converter 18 is connected to an exhaust pipe, muffler, and the like, conjointly schematically indicated at 20.

A so-called fluidic element 22 has a supply port or nozzle 24, a vent port 26, and outlet port 28, a first control port 30, a second control port 32 and an interaction region 34, as best seen in FIG. 2. Fuel supply line or conduit 36 connects a conventional float chamber 38 to the supply port 24 and a conventional pump 40, such as an electromagnetic pump, is fluidly disposed in the fuel supply line between the float chamber 38 and the fluidic element 22 to supply fuel from the float chamber 38 to the supply port 24 so that a fuel jet may be introduced into the interaction region 34 through the supply port 24. The float chamber 38 communicates with fuel tank (not shown) in a conventional manner. The vent port 26 of the fluidic element 22 is open to the float chamber 38 or fluid reservoir through a vent conduit 42. An air-fuel mixture circuit which is highly schematically illustrated in FIG. 1 connects the outlet port 28 of the fluidic element 22 with the induction passage 10, which air fuel circuit includes a main fuel passageway 44 having a main nozzle 46 opening to the induction passage 10, an idle and slow fuel passageway 48 having a nozzle 50 and a fuel adjustor 52. The control port 30 of the fluidic element 22 is open to the ambient atmosphere and maintained at the atmospheric pressure, whereas a vacuum line or conduit 54 connects the control port 32 with the venturi section 12 of the induction passage 10. A fixed flow restrictor 56 is disposed in the vacuum conduit 54 intermediate between the control port 32 of the fluidic element 22 and the venturi section 12 to apply venturi vacuum to the control port 32.

As best seen in FIG. 2 the fluidic element 22 has two passages 58 and 60 leading from the interaction region 34 to the ports 26 and 28, respectively. As fuel is supplied to the supply port 24 under pressure by means of the pump 40, the fuel jet is introduced in the interaction region 34 in the direction indicated by an arrow 62. As a splitter 64 which divides the passage 60 from the passage 58 is oriented at approximately 180° to the fuel jet (see arrow 62), the fuel jet separates into two flows leading to the vent port 26 and outlet port 28, respectively. The fuel flow through the passage 58 is indicated by an arrow 66 while the fuel flow through the passage 60 by an arrow 68. The control ports 30 and 32 are oriented at approximately 90° to the fuel jet 62 entering from the supply port 24. The ratio, in amount, of fuel flow 68 to fuel flow 66 varies in response to difference in magnitude between pressure applied to the control port 30 and pressure applied to the control port 32. As the control port 30 is exposed to the atmospheric pressure while the control port 32 is exposed to the vacuum which is variable, the ratio, in amount, of fuel flow 68 to fuel flow 66 increases as the vacuum at the port 32 increases.

Referring back to FIG. 1 another fluidic element which is similar in construction to the fluidic element 22 is now indicated at 22' and is circuited in the same manner. Thus like parts of the fluidic element 22' corresponding to those of the fluidic element 22 are indicated by the same reference numerals with primes respectively. A supply port 24' communicates through the conduit 36 with the pump 40 to receive fuel, a vent port 26' is open to the vent conduit 42, an output port is connected to the main passageway 44 and the idle and slow passageway 48 to supply fuel to them, a control port 30' is open to the atmosphere and a control port 32' communicates with the venturi section 12 of the induction passage 10 through the vacuum conduit 54. A fixed flow restrictor 56' is fluidly disposed in the vacuum conduit intermediate between the control port 32' and the venturi section 12 in the same manner as the fixed flow restrictor 56.

It will now be noted that the fluidic elements 22 and 22' are circuited in parallel between the pump 40 and main and idle passageways 44 and 48. Two fluidic elements are employed in the embodiment shown in FIG. 1 but the number of the fluidic elments are not limited to two because the number of fluidic elements may be varied in relation to the displacement volume of the engine. Thus less than two or more than two fluidic elements may be employed.

To vary the vacuum level at the control ports 32 and 32' in response not only to venturi vacuum but also to a controlled variable such as an output signal from an exhaust gas sensor such as a conventional oxygen sensor 70 placed in flow communication with exhaust gases flowing through the exhaust manifold 16, bypass conduits 72 and 74 are connected across the fixed flow restrictors 56 and 56' with the vacuum conduit 54, the bypass conduit 74 merging into the bypass conduit 72 as shown in FIG. 1. The bypass conduit 72 has one end connected to a portion on the vacuum conduit 54 between the control port 32 and the fixed flow restrictor 56 and has other end connected to a portion on the vacuum conduit 54 between the fixed flow restrictor 56 and the venturi section 12, while the bypass conduit 74 has one end connected to a portion on the vacuum conduit 54 between the control port 32' and the fixed flow restrictor 56' and the fixed flow restrictor 56' and has other end connected to the same portion on the vacuum conduit 54 to which the bypass conduit 72 is connected. To restrict fluid flow (represented by arrows 76) through the bypass conduit 72 in variable manner a normally closed valve 78 is fluidly disposed in the bypass conduit 72 and a solenoid actuator 80 is operatively connected with the valve 78 in such a manner that when the solenoid of the actuator 80 is energized the valve 78 is opened, while to restrict fluid flow (represented by the arrows 76) through the bypass conduit 74 in variable manner a normally closed valve 82 is fluidly disposed in the bypass conduit 74 and a solenoid actuator 84 is operatively connected with the valve 82 in such a manner that when the solenoid of the actuator 84 is energized the valve 82 is opened.

Figure 3:
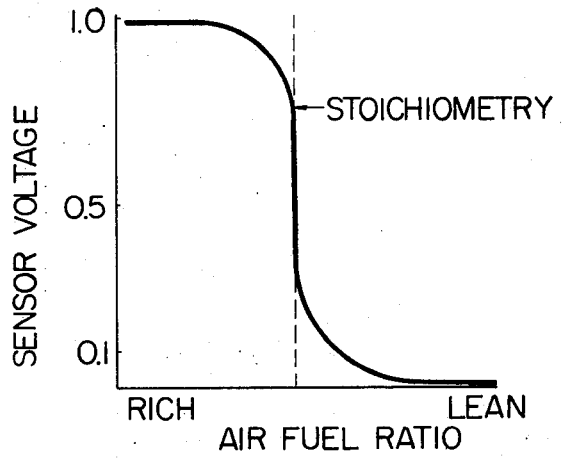
FIG. 3 is an operating diagram of an oxygen sensor.

Referring to FIG. 3 a step change in sensor voltage of the oxygen sensor 70 near stoichiometry is shown. This sensor voltage is fed to an electronic controller 86 (see FIG. 1) the details of which is shown in block diagram in FIG. 4 and from the electronic controller 86 an electronic feedback signal is applied to the solenoid actuators 80 and 84 to energize the same.

The solenoid actuators 80 and 84 are of the character that they open the respective valves 78 and 82 in an ON-OFF manner in response to the electronic feedback signal from the electronic controller 86. The electronic feedback signal is in the form of a square shaped pulsating voltage having a constant frequency and having a pulse width which is variable in such a manner that when the sensor voltage indicates that the air fuel ratio is less than a predetermined air fuel ratio such as the stoichiometry the ratio of opening time of the valves 78 and 82 per unit time decreases so that flow resistance through the bypass conduits 72 and 74 increases and that when the sensor voltage indicates that the air fuel ratio is greater than the predetermined air fuel ratio the ratio of opening time of the valves 78 and 82 per unit time increases so that flow resistance through the bypass conduits 72 and 74 decreases. As the flow resistance through the bypass conduits 72 and 74 increases, the vacuum being applied to the control ports 32 and 32' decreases thus decreasing fuel supply from the output ports 28 and 28', while as the flow resistance through the bypass conduit 72 and 74 decreases the vacuum being applied to the control ports 32 and 32' increases toward the venturi vacuum thus increasing fuel supply from the output ports 28 and 28'. It will thus be understood that air-fuel mixture being applied to the engine becomes lean as the flow resistance through the bypass conduits 72 and 74 is great while the mixture becomes rich as the flow resistance through the bypass conduits 72 and 74 is little.

Figure 5:
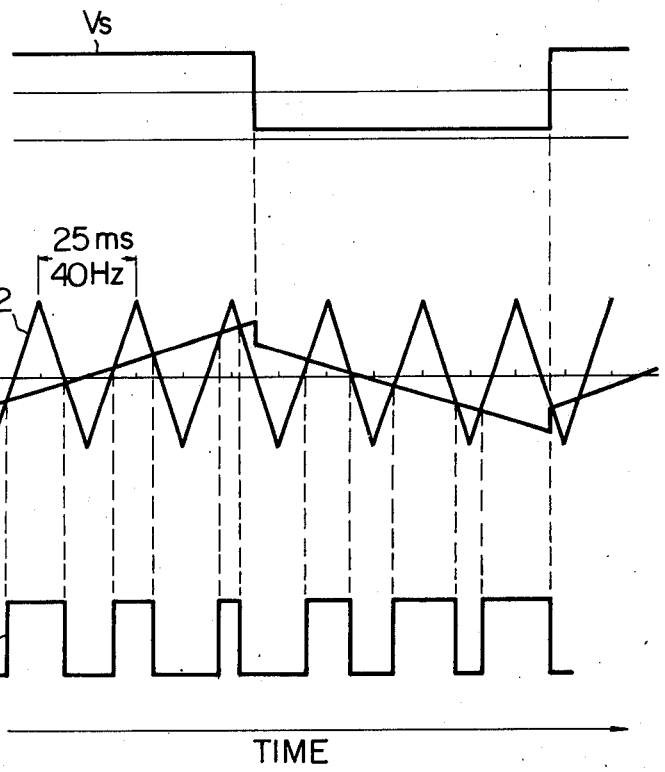
FIG. 5 is a general diagram of the output voltage of an oxygen sensor in the exhaust path, with respect to time, the output signal from the output of a proportional and integral controller and the output signal from a pulse generator.
Figure 4:
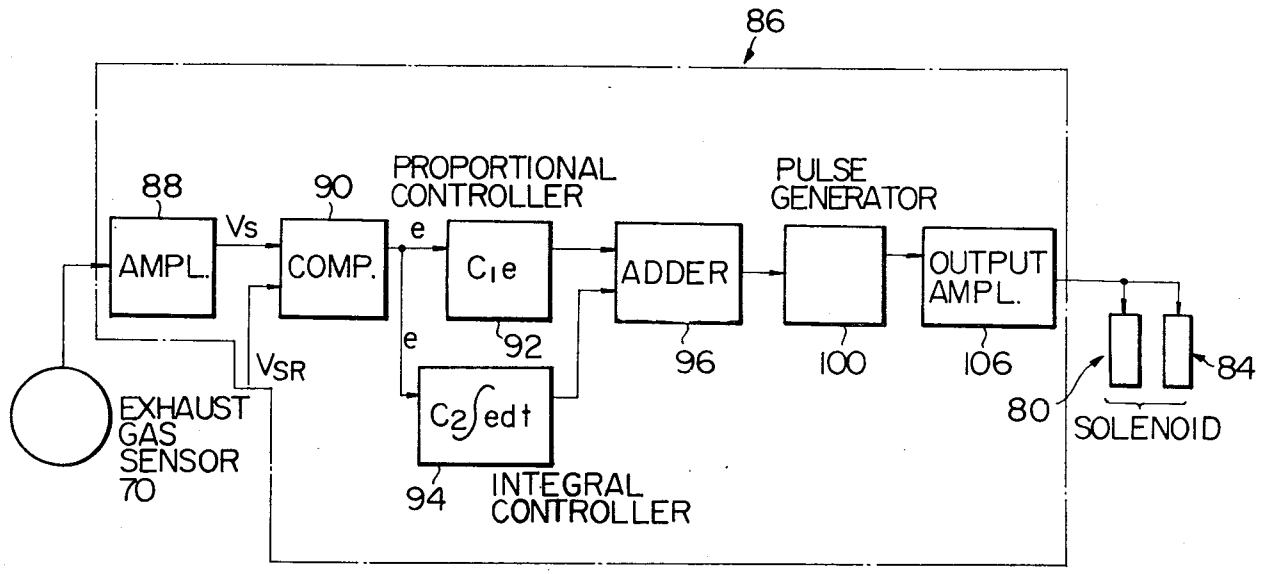
FIG. 4 is a schematic block circuit diagram of an electronic controller.

The details of the electronic controller 86 will now be described with reference to FIGS. 3 through 5. FIG. 4 illustrates a block diagram of the electronic controller 86, in which the sensor voltage is amplified by an amplifier 88 and the amplified sensor voltage $V_S$ is compared with a sensor reference voltage $V_{SR}$ by a comparator 90 to provide an error signal *e*. The error signal *e* is applied to both a proportional controller 92 and an integral controller 94. The output signals from the proportional controller 92 and the integral controller 94 are added in an adder 96 and a signal as indicated at 98 in FIG. 5 is produced at the output of the adder 96. This output signal 98 is fed to a pulse generator 100 which accommodates therein a generator (not shown) for producing a series of triangular pulses as indicated at 102 in FIG. 5. The pulse generator 100 provides at its output a series of rectangular pulses as indicated at 104 in FIG. 5. This series of rectangular pulses 104 is amplified by an output amplifier 106 and then fed to the solenoids 80 and 84.

Although in the embodiment shown in FIG. 1 the valves 78 and 82 are actuated in an ON-OFF manner these valves 78 and 82 may be actuated in a continuous manner if desired. Although in the embodiment shown in FIG. 1 the bypass passages 72 and 74 having valves 78 and 82 are provided to control the vacuum being applied to the control ports 32 and 32', the vacuum applied to the control ports 32 and 32' may be controlled, if desired, by connecting an ambient air intake conduit to a portion on the vacuum conduit 54 nearer to the control ports 32, 32' than the fixed flow restrictors 56 and 56' and providing a solenoid actuated valve (not shown) in the air intake conduit to vary the flow restriction through the intake air conduit.

From the preceding description of the present invention, it will be appreciated that the air-fuel metering system includes increased accuracy in obtaining desired air fuel ratio of air-fuel mixture being applied to an internal combustion engine.

What is claimed is:

1. An air-fuel metering system for an internal combustion engine, comprising:

an induction passage with a venturi section;

a fuel reservoir;

a pump providing a source of fuel flow and pressure;

a fluidic element having a supply port in communication with the fuel from the pump, a vent port in communication with the fuel reservoir and an outlet port, the fluidic element further having a first control port exposed to the atmospheric pressure and a second control port;

a vacuum conduit connecting the second control port with the venturi section of the induction passage, the vacuum conduit having a fixed flow restrictor therein;

air-fuel mixture circuit means connecting the outlet port of the fluidic element with the induction passage;

the fluidic element being so constructed and arranged as to increase fuel flow from the supply port to the outlet port in response to an increase in the vacuum applied to the second control port;

a second conduit having one end connected to the vacuum conduit at a location thereof intermediate the fixed flow restrictor and the second control port of the fluidic element and other end connected to the vacuum conduit at a location thereof intermediate the fixed flow restrictor and the venturi section;

means for generating an output signal indicative of the character of the exhaust gases;

means for generating a feedback signal responsive to the output signal from the output signal generating means; and solenoid valve means for restricting fluid flow through the second conduit responsive to the feedback signal.

2. An air-fuel metering system for an internal combustion engine, comprising:

an induction passage with a venturi section;

a fuel reservoir;

a pump providing a source of fuel flow and pressure;

a fluidic element having a supply port in communication with the fuel from the pump, a vent port in communication with the fuel reservoir and an outlet port, the fluidic element further having a first control port exposed to the atmospheric pressure and a second control port;

a vaccum conduit connecting the second control port with the venturi section of the induction passage, the vacuum conduit having a fixed flow restrictor therein;

air-fuel mixture circuit means connecting the outlet port of the fluidic element with the induction passage;

the fluidic element being so constructed and arranged as to increaseful flow from the supply port to the outlet port in response to an increase in the vacuum applied to the second control port;

a second conduit having one end connected to the vacuum conduit at a location thereof intermediate the fixed flow restrictor and the second control port of the fluidic element and other end opening to the ambient atmosphere;

means for generating an output signal indicative of the character of the exhaust gases;

means for generating a feedback signal responsive to the output signal from the output signal generating means; and solenoid valve means for restricting fluid flow through the second conduit responsive to the feedback signal.

3. An air-fuel metering system for an internal combustion engine, comprising:

an induction passage with a venturi section;

a fuel reservoir;

a pump providing a source of fuel flow and pressure;

a fluidic element having a supply port in communication with the fuel from the pump, a vent port in communication with the fuel reservoir and an outlet port, the fluidic element further having a first control port exposed to the atmospheric pressure and a second control port;

a vacuum conduit connecting the second control port with the venturi section of the induction passage, the vacuum conduit having a fixed flow restrictor therein;

air-fuel mixture circuit means connecting the outlet port of the fluidic element with the induction passage;

the fluidic element being so constructed and arranged as to increase fuel flow from the supply port to the outlet port in response to an increase in the vacuum applied to the second control port;

a second conduit having one end connected to the vacuum conduit at a location thereof intermediate the fixed flow restrictor and the second control port of the fluidic element and other and connected to the vacuum conduit at a location thereof intermediate the fixed flow restrictor and the venturi section;

means for generating an output signal indicative of the character of the exhaust gases;

means for generating a feedback signal responsive to the output signal from the output signal generating means, the feedback signal being in the form of a series of rectangular pulses; and solenoid valve means for restricting fluid flow through the second conduit responsive to the feedback signal.

* * * * *